US007439681B2

(12) United States Patent
Okawa

(10) Patent No.: US 7,439,681 B2
(45) Date of Patent: Oct. 21, 2008

(54) BALLAST AND PROJECTOR

(75) Inventor: Kazuo Okawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 169 days.

(21) Appl. No.: 11/442,820

(22) Filed: May 30, 2006

(65) Prior Publication Data

US 2006/0279229 A1 Dec. 14, 2006

(30) Foreign Application Priority Data

Jun. 10, 2005 (JP) ..... 2005-171057

(51) Int. Cl.
*H05B 37/02* (2006.01)

(52) U.S. Cl. ..... 315/209 R; 315/224

(58) Field of Classification Search ..... 315/209 R, 315/274, 276, 224, 291, 82, 307, 363, DIG. 7
See application file for complete search history.

(56) References Cited

U.S. PATENT DOCUMENTS 6,104,147 A * 8/2000 Nakamura et al. ..... 315/289
6,483,257 B1 * 11/2002 Henderson et al. ..... 315/291
2003/0122505 A1 * 7/2003 Huber et al. ..... 315/291
2005/0140311 A1 * 6/2005 Suzuki et al. ..... 315/209 R
2007/0228997 A1 * 10/2007 Hirschmann et al. ..... 315/276

FOREIGN PATENT DOCUMENTS

JP 2003-316440 A 11/2003
JP 2003-151786 A 5/2005

* cited by examiner

*Primary Examiner*—Douglas W. Owens
*Assistant Examiner*—Ephrem Alemu
(74) *Attorney, Agent, or Firm*—AdvantEdge Law Group, LLC

(57) ABSTRACT

The disclosure is directed to a ballast and a projector. In one embodiment, a ballast comprises an igniter circuit. The igniter circuit is configured to apply a first voltage and a second voltage having opposite polarities to a base electrode and a leading electrode of a high-pressure discharge lamp. At a start of a lighting of the lamp an absolute value of the first voltage applied to one of the electrodes of the lamp is larger than an absolute value of the second voltage applied to the other of the electrodes of the lamp.

20 Claims, 4 Drawing Sheets

BALLAST AND PROJECTOR

BACKGROUND

1. Technical Field

The present invention relates to a ballast for igniting a high-pressure discharge lamp such as a high-pressure mercury lamp and metal halide lamp, and a projector incorporating the ballast.

2. Related Art

Generally, an igniter circuit has been contained in a ballast, and a high-pressure discharge lamp has been lighted by applying the output of a symmetrical igniter circuit to both electrodes of the high-pressure discharge lamp, or applying the output of an igniter circuit to one electrode of the high-pressure discharge lamp at the time of lighting (see JP-A-2003-316440 and JP-A-2003-151786).

By the way, the structure of the high-pressure discharge lamp causes cooling imbalance between of right and left electrodes at the time of extinction after lighting. When the enclosed mercury liquefies, it adheres more to the electrode at lower temperature (generally, the electrode at the base side) due to the cooling imbalance. Consequently, there has been a problem that, at the next lighting, slow rise in electrode temperature and little progress of mercury vaporization because of undetermined position of glow discharge depending on the output of the normal igniter circuit result in lighting defect. Further, in the lamp for supplying the output of the igniter circuit to one electrode only, there has been a problem that the dielectric strength around the one electrode must be naturally made greater.

SUMMARY

An advantage of some aspects of the invention is to provide a ballast that eliminates occurrence of lighting defect and reduced dielectric strength, and a projector mounting the ballast.

A ballast according to at least one embodiment includes an igniter circuit that applies voltages having opposite polarities to a base electrode and a leading electrode of a high-pressure discharge lamp and makes an absolute value of the voltage applied to one electrode of the base electrode and the leading electrode larger than an absolute value of the voltage applied to the other electrode at the start of lighting. The high-pressure discharge lamp becomes easier to generate plasma as the voltages to the ground of the electrodes are higher, and further, glow discharge occurs from the electrode with higher voltage to the ground toward the electrode with lower voltage to the ground. Therefore, according to at least one embodiment, a difference in applied voltages (absolute values) is provided between the base electrode and the leading electrode of the high-pressure discharge lamp so that the high voltage is applied between them. Accordingly, stable glow discharge is obtained and rise in electrode temperature is promoted even in a condition in which the adherence of mercury to the electrodes is out of balance, for example. Further, in high voltage application to the high-pressure discharge lamp, since the base electrode and the leading electrode are burdened with the applied voltages, respectively, dielectric strength of the connector of the base electrode, for example, can be reduced. In the embodiment, the base electrode refers to an electrode at the side at which the reflection mirror or the like is attached, and the leading electrode refers to an electrode located at the opposite side to the base electrode.

A ballast according to at least one embodiment includes an igniter circuit that applies voltages having opposite polarities to a base electrode and a leading electrode of a high-pressure discharge lamp and makes an absolute value of the voltage applied to the leading electrode larger than an absolute value of the voltage applied to the base electrode at the start of lighting. While the base electrode of the high-pressure discharge lamp is difficult to have a sharp shape because of a mercury film, the leading electrode is not. In at least one embodiment, stable glow discharge is obtained because glow discharge from the leading electrode to the base electrode is allowed to occur by applying a relatively higher voltage (absolute value) to the leading electrode of the high-pressure discharge lamp.

A ballast according to at least one embodiment includes an igniter circuit that applies voltages having opposite polarities to a base electrode and a leading electrode of a high-pressure discharge lamp and makes an absolute value of the voltage applied to the base electrode larger than an absolute value of the voltage applied to the leading electrode at the start of lighting. In at least one embodiment, stable glow discharge is obtained because glow discharge from the base electrode to the leading electrode of the high-pressure discharge lamp is allowed to occur.

Further, in at least one embodiment the igniter circuit outputs voltages with the absolute value of the voltage applied to the leading electrode at least 1 KV higher than the absolute value of the voltage applied to the base electrode.

In at least one embodiment, that the igniter circuit outputs the voltage applied to the base electrode and the voltage applied to the leading electrode in synchronization with each other.

In at least one embodiment, the igniter circuit includes an igniter transformer having one primary winding and two secondary windings, the number of turns of one secondary winding is larger than the number of turns of the other secondary winding and both have opposite polarities, the output end of the one secondary winding is connected to the electrode side to be applied with the voltage having the larger absolute value of the electrodes of the high-pressure discharge lamp, and the output end of the other secondary winding is connected to the electrode side to be applied with the voltage having the smaller absolute value of the electrodes of the high-pressure discharge lamp.

In at least one embodiment, the igniter circuit includes two igniter transformers each having a primary winding and a secondary winding, the number of turns of the secondary winding of one igniter transformer is larger than the number of turns of the secondary winding of the other igniter transformer and both characteristics have opposite polarities, the output end of the secondary winding of the one igniter transformer is connected to the electrode side to be applied with the voltage having the larger absolute value of the electrodes of the high-pressure discharge lamp, and the output end of the secondary winding of the other igniter transformer is connected to the electrode side to be applied with the voltage having the smaller absolute value of the electrodes of the high-pressure discharge lamp.

In at least one embodiment, an igniter transformer drive circuit that supplies exciting current at the staff of lighting is provided to the primary winding of the igniter transformer.

A projector according to at least one embodiment includes a high-pressure discharge lamp; the above described ballast; a display panel; an optical unit that guides light from the high-pressure discharge lamp to the display panel; and a projection unit that projects an image depicted on the display panel onto a screen. According to at least one embodiment, the situation that lighting defect of the high-pressure discharge lamp occurs at the start of projection is avoided by providing the ballast.

BRIEF DESCRIPTION OF THE DRAWINGS

Certain embodiments will be described with reference to the accompanying drawings, wherein like numbers reference like elements.

DESCRIPTION OF EXEMPLARY EMBODIMENTS

Embodiment 1

Figure 1:
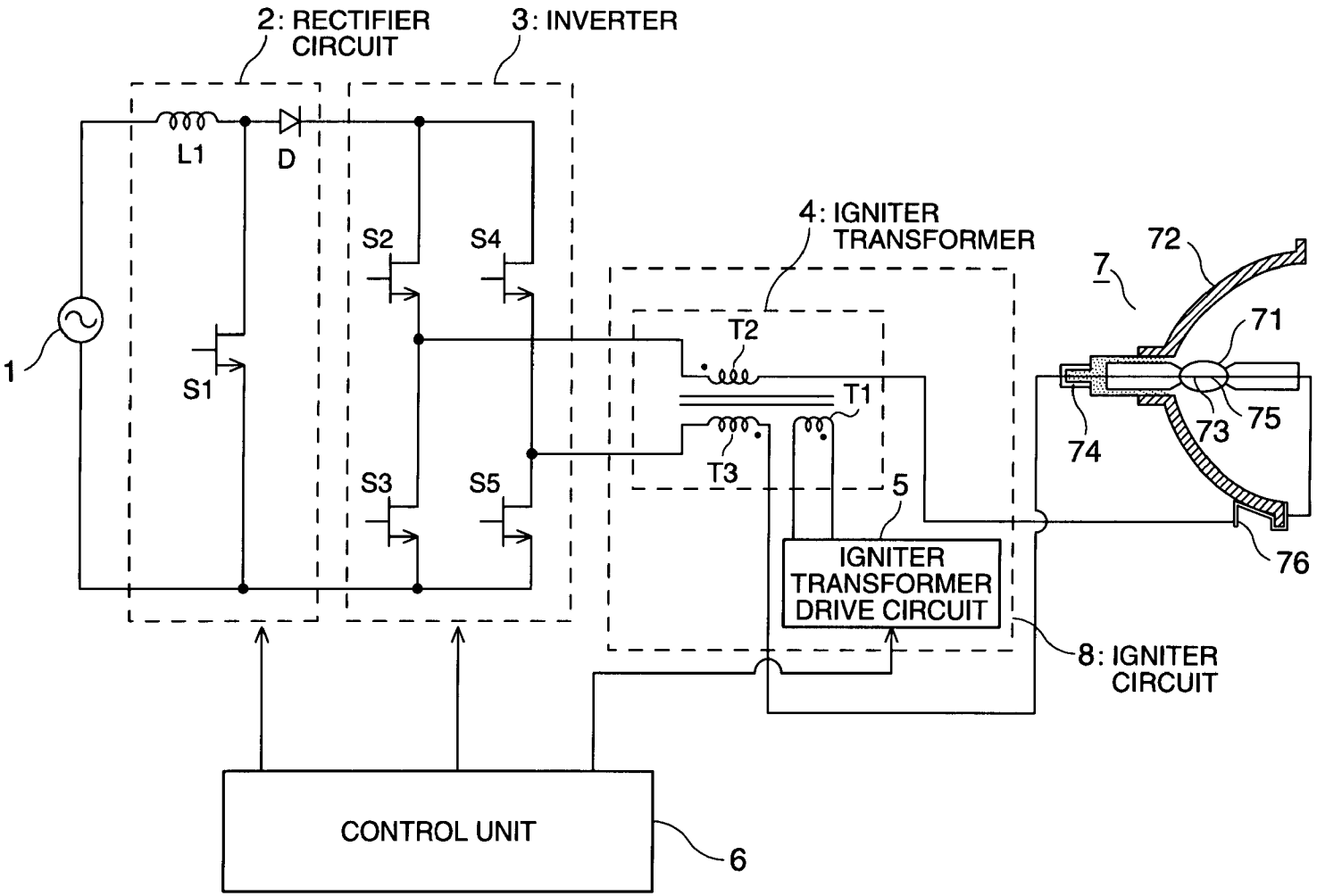
FIG. 1 is a circuit diagram of a ballast according to at least one embodiment.

FIG. 1 is a circuit diagram of a ballast according to the embodiment 1 of the invention. The ballast includes a rectifier circuit 2 that rectifies an alternating-current source 1, an inverter 3, an igniter transformer 4, an igniter transformer drive circuit 5, and an control unit 6, and a high-pressure discharge lamp 7 is connected to the output end of the igniter transformer 4. The rectifier circuit 2 includes inductor L1, switching element S1 and diode D. The inverter 3 includes four switching elements S2 to S5 in full-bridge connection. The switching elements S2, S5 and S3, S4 are alternately ON-controlled for converting the direct-current voltage from the rectifier circuit 2 into alternating-current voltage and outputting it to the igniter transformer 4. The igniter transformer 4 outputs a high voltage to the high-pressure discharge lamp 7 in a manner as described later. The high-pressure discharge lamp 7 is a reflective light source device, and an arc tube 71 is fixed to the central part of a reflection mirror 72 via heat-resistant cement, an electrode 73 led out from one end of the arc tube 71 (the base electrode in the invention) is connected to a base 74, and the base 74 is connected to one end of the output of the igniter transformer 4. Further, an electrode 75 led out from the other end of the arc tube 71 (the leading electrode in the invention) is connected to the periphery of the reflection mirror 72 via a base 76, and the base 76 is connected to the other end of the output of the igniter transformer 4. The above described rectifier circuit 2, inverter 3, and igniter transformer drive circuit 5 are respectively and appropriately controlled by the control unit 6. The high-pressure discharge lamp 7 is type of horizontal lighting with the arc tube 71 horizontally provided, and the igniter transformer 4 and the igniter transformer drive circuit 5 form an igniter circuit 8 of the invention.

Figure 2:
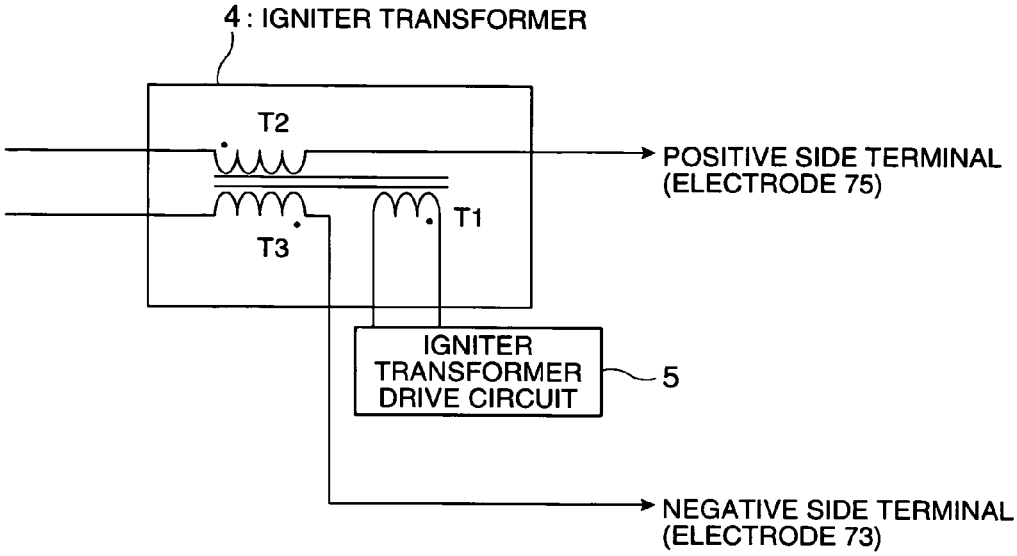
FIG. 2 is a circuit diagram showing details of an igniter transformer.

FIG. 2 is a circuit diagram showing details of the igniter transformer 4 in FIG. 1. The igniter transformer 4 includes one primary winding T1 and two secondary windings T2, T3. Regarding the secondary windings T2 and T3, the output voltages have opposite polarities and the numbers of turns have a relationship of T2>T3, and the absolute value of the output voltage of the secondary winding T2 is larger than the absolute value of the output voltage of the secondary winding T3. For example, under the condition in which the switching elements S2 and S5 are ON, when exciting current is supplied to the primary winding T1 by the igniter transformer drive circuit 5, dielectric voltages having opposite polarities are generated in the secondary windings T2 and T3 in synchronization with each other, and the output of the secondary winding T2 is supplied to the base 76 (electrode 75) of the high-pressure discharge lamp 7 and the output of the secondary winding T3 is supplied to the base 74 (electrode 73) of the high-pressure discharge lamp 7.

Figure 3:
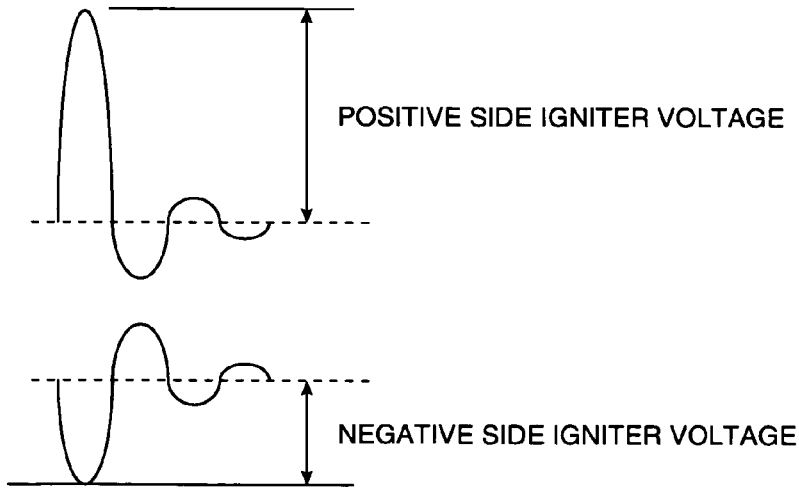
FIG. 3 is an output waveform chart of the igniter transformer.

FIG. 3 is an output waveform chart of the igniter transformer 4. A positive voltage is output from the secondary winding T2 and a negative voltage is output from the secondary winding T3. Since the numbers of turns of the secondary windings T2 and T3 have the relationship of T2>T3 as described above, the amplitude of the output voltage of T2>the amplitude of the output voltage of T3. The difference between both outputs is a voltage to be supplied to the high-pressure discharge lamp 7, and the voltage (absolute value) supplied to the electrode at the positive side is larger than the voltage (absolute value) supplied to the electrode at the negative side. The output voltage of the secondary winding T3 is equal to or more than 1 KV, and the difference between the output voltage (absolute value) of the secondary winding T2 and the output voltage (absolute value) of the secondary winding T3 is desirably at least equal to or more than 1 KV.

In the light source device shown in FIGS. 1 and 2, the switching element S1 of the rectifier circuit 2 is controlled by the control unit 6 to output a direct-current voltage to the inverter 3 side. The switching elements S2, S5 or S3, S6 of the inverter 3 are ON-controlled by the control unit 6, and the inverter outputs the output voltage thereof to the igniter transformer 4. When exciting current is supplied to the primary winding T1 of the igniter transformer 4 by an igniter transformer drive circuit 42, an output voltage with waveforms as shown in FIG. 3 is obtained. The output of the secondary winding T2 is supplied to the base 76 of the high-pressure discharge lamp 7, and the output of the secondary winding T3 is supplied to the base 74 of the high-pressure discharge lamp 7. The difference voltage between the output of the secondary winding T2 and the output of the secondary winding T3 is applied to the arc tube 71 of the high-pressure discharge lamp 7, dielectric breakdown occurs in the arc tube 71, and glow discharge starts and makes the shift to the arc discharge. The control unit 6 controls the inverter 3 to supply direct current or high-frequency current (e.g., 30 to 40 kHz) to the arc tube 71 in a predetermined period for preheating, and then, supply alternating current (pulse current) of 100 to 400 Hz at steady lighting, for example, to ignite the arc tube 71.

As described above, in the embodiment 1, while the electrode 73 (base electrode) is difficult to have a sharp shape because a mercury film is formed, the leading electrode is not. Accordingly, a higher voltage (absolute value) is applied to the electrode 75 (leading electrode) of the high-pressure discharge lamp 7 than that to the electrode 73 (base electrode), and stable glow discharge from the electrode 75 (leading electrode) to the electrode 73 (base electrode) is obtained and the rise in electrode temperature is promoted. Further, in high voltage application to the high-pressure discharge lamp 7, since the electrode 75 (leading electrode) and the electrode 73 (base electrode) are burdened with the applied voltages (with opposite polarities), respectively, the dielectric strength of the connector of the electrode 75 (leading electrode) can be reduced.

Embodiment 2

Figure 4:
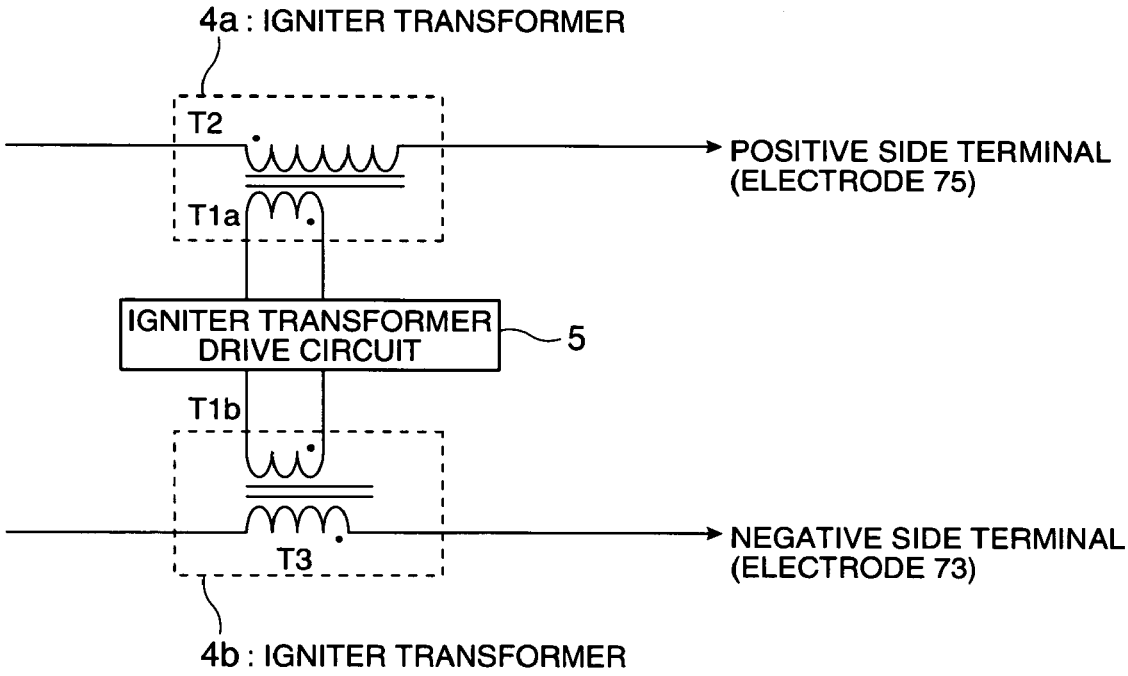
FIG. 4 is a circuit diagram of another example of igniter transformer.

FIG. 4 is a circuit diagram of an igniter transformer 4 according to the embodiment 2 of the invention. The igniter transformer 4 includes two igniter transformers 4*a* and 4*b*. When exciting current is supplied to primary windings T1*a*, T1*b* under the control by the igniter transformer drive circuit 5, output voltages similar to those shown in FIG. 3 are obtained from the secondary windings T2 and T3.

Embodiment 3

Figure 5:
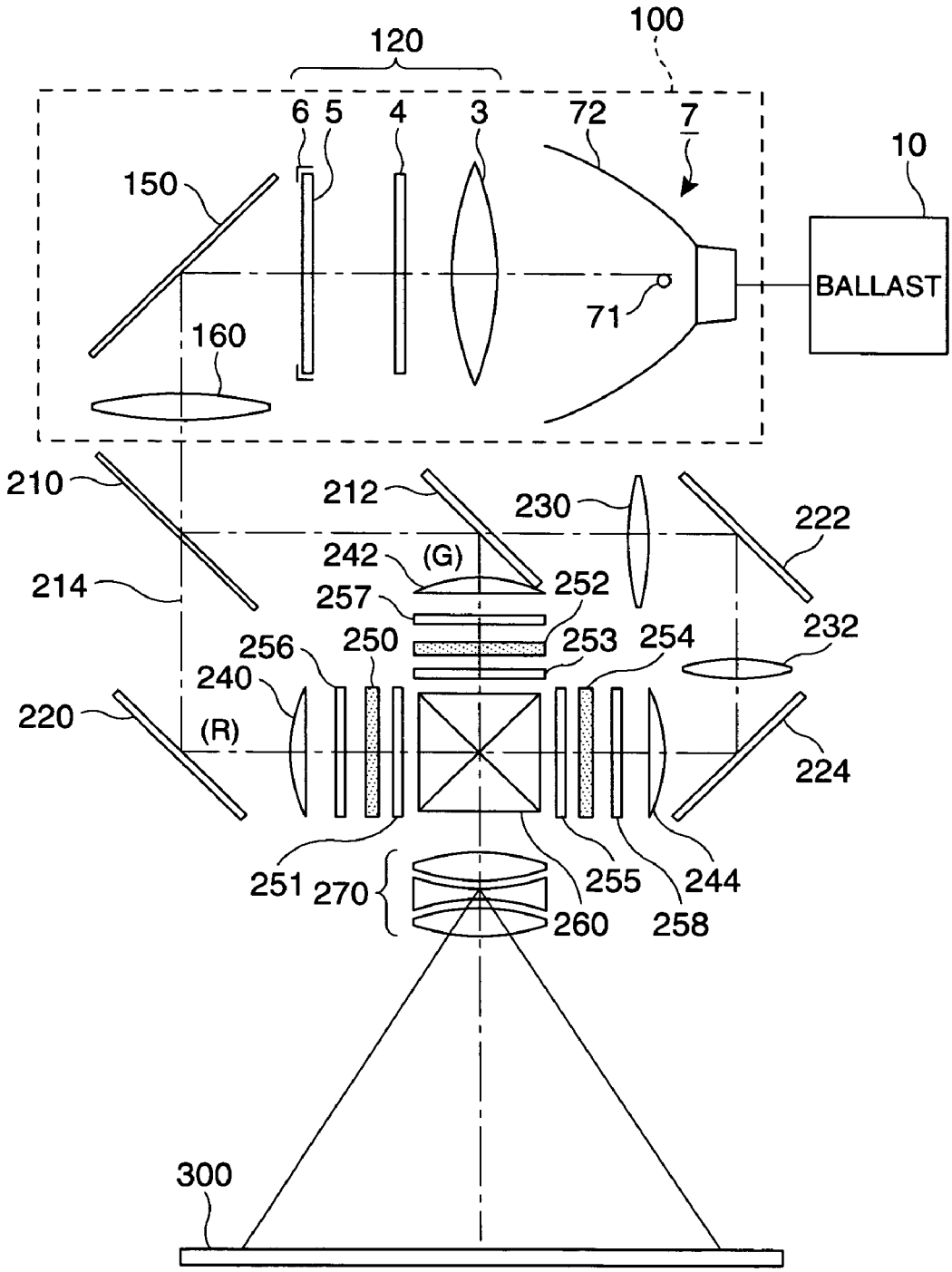
FIG. 5 is an optical system configuration diagram of a projector.

FIG. 5 is an optical system configuration diagram of a projector incorporating the ballast of the above described embodiment 1 or 2 into an illumination system. The ballast 10 in FIG. 5 includes the rectifier circuit 2, inverter 3, igniter transformer 4, igniter transformer drive circuit 5, and control unit 6 in FIG. 1. Since the high-pressure discharge lamp 7 of an illumination system 100 is ignited in the above described manner, the situation that lighting defect of the high-pressure discharge lamp occurs at the start of projection is avoided.

The projector includes the illumination system 100, dichroic mirrors 210, 212, reflection mirrors 220, 222, 224, a light incident-side lens 230, a relay lens 232, three field lenses 240, 242, 244, three liquid crystal panels 250, 252, 254, polarizers 251, 253, 255, 256, 257, 258 respectively disposed at the light incident-sides and light exiting-sides of the respective liquid crystal panels, a cross dichroic prism 260, and a projection lens 270.

The illumination system 100 includes a light source 110 that outputs a nearly parallel pencil of light, an illumination device 120, a reflection mirror 150, and a condenser lens 160. The light source 110 includes the high-pressure discharge lamp 7 (see FIG. 1) as a radiation source that outputs radial beams. The light radiated from the light source 110, the brightness of which is uniformized in the illumination device 120, then enters the condenser lens 160 via the reflection mirror 150. The condenser lens 160 allows the uniform light output from the illumination device 120 to enter the panel faces of the liquid crystal panels 250, 252, 254.

Further, the two dichroic mirrors 210, 212 form a color light separation system 214 that separates the light output from the illumination system 100 into three color lights of red (R), green (G), and blue (B). The first dichroic mirror 210 transmits the red light component of the light output from the illumination system 100 and reflects the blue light component and green light component.

The red light transmitted through the first dichroic mirror 210 is reflected by the reflection mirror 220, passes through the field lens 240, and reaches the liquid crystal panel 250 for red light. The field lens 240 has a collecting function of bringing the respective passing partial pencils of light into luminous flux in parallel with the principal ray (central axis) of the respective partial pencils of light. The field lenses 242, 244 provided before the other liquid crystal panels act similarly.

Of the blue light and green light reflected by the first dichroic mirror 210, the green light is reflected by the second dichroic mirror 212, passes through the field lens 242, and reaches the liquid crystal panel 252 for green light. On the other hand, the blue light is transmitted through the second dichroic mirror 212 and passes through the light incident-side lens 230 and a relay lens system including the relay lens 232 and the reflection mirrors 222, 224. The blue light that has passed through the relay lens system further passes through the field lens 244 and reaches the liquid crystal panel 254 for blue light.

The three liquid crystal panels 250, 252, 254 have functions as light modulation devices that convert the entering respective color lights into lights for forming images according to given image signals and output the lights. There are the polarizers 256, 257, 258 at the light incident-sides of the liquid crystal panels 250, 252, 254 and the polarizers 251, 253, 255 are provided at the light exiting-sides of the liquid crystal panels 250, 252, 254, respectively, and the polarization directions of the respective color lights are adjusted thereby. The lights that have passed through these liquid crystal panels 250, 252, 254 enter the cross dichroic prism 260.

The cross dichroic prism 260 has a function as a color light combining system that combines three color lights output from the three liquid crystal panels 250, 252, 254. In the cross dichroic prism 260, a dielectric multilayer film that reflects red light and a dielectric multilayer film that reflects blue light are formed at interfaces of four right angle prisms substantially in an X-shaped configuration. Three color lights are combined by these dielectric multilayer films to form combined light for projection of a color image. The combined light produced by the cross dichroic prism 260 enters the projection lens 270 and is projected onto a projection screen 300 therefrom. Thereby, images displayed on the liquid crystal panels 250, 252, 254 are projected onto the projection screen 300.

Embodiment 4

In the above described embodiments 1, 2, the example in which the voltage applied to the electrode 75 (leading electrode) is larger (absolute value) than the voltage applied to the electrode 73 (base electrode), however, they may be reversed. In this case, stable glow discharge from the electrode 73 (base electrode) to the electrode 75 (leading electrode) is obtained. Further, the example in which one igniter transformer drive circuit 5 is provided for the igniter transformers 4*a* and 4*b* as means for generating imbalance between igniter voltages has been described, however, two igniter transformer drive circuits respectively corresponding to the igniter transformers 4*a* and 4*b* may be provided. Furthermore, in the above embodiment 3, the example of the liquid crystal panels (LCDs) as display panels of the projector has been described, however, not only those but also, for example, digital mirrors or the like may be used.

The entire disclosure of Japanese Patent Application No.2005-171057, filed Jun. 10, 2005 is expressly incorporated by reference herein.

What is claimed is:

1. A ballast comprising an igniter circuit, the igniter circuit configured to receive power from a power source and apply a first voltage and a second voltage having opposite polarities to a base electrode and a leading electrode of a high-pressure discharge lamp and wherein at a start of a lighting of the lamp an absolute value of the first voltage applied to one of the electrodes of the lamp is larger than an absolute value of the second voltage applied to the other of the electrodes of the lamp.

2. A ballast comprising an igniter circuit, the igniter circuit configured to receive power from a power source and apply a first voltage and a second voltage having opposite polarities to a base electrode and a leading electrode of a high-pressure discharge lamp and wherein at a start of a lighting of the lamp an absolute value of the first voltage applied to the leading electrode is larger than an absolute value of the second voltage applied to the base electrode.

3. A ballast comprising an igniter circuit, the igniter circuit configured to receive power from a power source and apply a first voltage and a second voltage having opposite polarities to a base electrode and a leading electrode of a high-pressure discharge lamp and wherein at a start of a lighting of the lamp an absolute value of the first voltage applied to the base electrode is larger than an absolute value of the second voltage applied to the leading electrode.

4. The ballast according to claim 1, wherein the first voltage is applied to the leading electrode and the second voltage is applied to the base electrode and the absolute value of the first voltage is at least 1 KV higher than the absolute value of the second voltage.

5. The ballast according to claim 1, wherein the igniter circuit is configured to supply the first and second voltages to the base electrode and the leading electrode in synchronization with each other.

6. The ballast according to claim 2, wherein the igniter circuit is configured to supply the first and second voltages to the base electrode and the leading electrode in synchronization with each other.

7. The ballast according to claim 3, wherein the igniter circuit is configured to supply the first and second voltages to the base electrode and the leading electrode in synchronization with each other.

8. The ballast according to claim 4, wherein the igniter circuit is configured to supply the first and second voltages to the base electrode and the leading electrode in synchronization with each other.

9. The ballast according to claim 1, wherein the igniter circuit further includes an igniter transformer having a primary winding; and two secondary windings, each of the secondary windings having an output end and a number of turns and configured so as to produce the opposite polarities of the first and second voltages, and wherein the number of turns of one of the secondary windings is larger than the number of turns of the other of the secondary windings, and the output end of the one of the secondary windings is configured to supply the first voltage to the one of the electrodes of the lamp, and the output end of the other of the secondary windings is configured to supply the second voltage to the other of the electrodes of the lamp.

10. The ballast according to claim 2, wherein the igniter circuit further includes an igniter transformer having a primary winding; and two secondary windings, each of the secondary windings having an output end and a number of turns and configured so as to produce the opposite polarities of the first and second voltages, and wherein the number of turns of one of the secondary windings is larger than the number of turns of the other of the secondary windings, and the output end of the one of the secondary windings is configured to supply the first voltage to the leading electrode of the lamp, and the output end of the other of the secondary windings is configured to supply the second voltage to the base electrode of the lamp.

11. The ballast according to claim 3, wherein the igniter circuit further includes an igniter transformer having a primary winding; and two secondary windings, each of the secondary windings having an output end and a number of turns and configured so as to produce the opposite polarities of the first and second voltages, and wherein the number of turns of one of the secondary windings is larger than the number of turns of the other of the secondary windings, and the output end of the one of the secondary windings is configured to supply the first voltage to the base electrode of the lamp, and the output end of the other of the secondary windings is configured to supply the second voltage to the leading electrode of the lamp.

12. The ballast according to claim 4, wherein the igniter circuit further includes an igniter transformer having one primary winding; and two secondary windings, each of the secondary windings having an output end and a number of turns and configured so as to produce the opposite polarities of the first and second voltages, and wherein the number of turns of one of the secondary windings is larger than the number of turns of the other of the secondary windings, and the output end of the one of the secondary windings is configured to supply the first voltage to the one of the electrodes of the lamp, and the output end of the other of the secondary windings is configured to supply the second voltage to the other of the electrodes of the lamp.

13. The ballast according to claim 1, wherein the igniter circuit includes a first and a second igniter transformer, each of the transformers having a primary winding; and a secondary winding having an output end and a number of turns, and wherein the number of turns of the secondary winding of the first igniter transformer is larger than the number of turns of the secondary winding of the second igniter transformer and the secondary windings are configured so as to produce the first and second voltages having opposite polarities, and the output end of the secondary winding of the first igniter transformer is configured to supply the first voltage to the one of the electrodes of the lamp, and the output end of the secondary winding of the second igniter transformer is configured to supply the second voltage to the other of the electrodes of the lamp.

14. The ballast according to claim 2, wherein the igniter circuit includes a first and a second igniter transformer, each of the transformers having a primary winding; and a secondary winding having an output end and a number of turns, and wherein the number of turns of the secondary winding of the first igniter transformer is larger than the number of turns of the secondary winding of the second igniter transformer and the secondary windings are configured so as to produce the first and second voltages having opposite polarities, and the output end of the secondary winding of the first igniter transformer is configured to supply the first voltage to the leading electrode of the lamp, and the output end of the secondary winding of the second igniter transformer is configured to supply the second voltage to the base electrode of the lamp.

15. The ballast according to claim 3, wherein the igniter circuit includes a first and a second igniter transformer, each of the transformers having a primary winding; and a secondary winding having an output end and a number of turns, and wherein the number of turns of the secondary winding of the first igniter transformer is larger than the number of turns of the secondary winding of the second igniter transformer and the secondary windings are configured so as to produce the first and second voltages having opposite polarities, and the output end of the secondary winding of the first igniter transformer is configured to supply the first voltage to the base electrode of the lamp, and the output end of the secondary winding of the second igniter transformer is configured to supply the second voltage to the leading electrode of the lamp.

16. The ballast according to claim 4, wherein the igniter circuit includes a first and a second igniter transformer, each of the transformers having a primary winding; and a secondary winding having an output end and a number of turns, and wherein the number of turns of the secondary winding of the first igniter transformer is larger than the number of turns of the secondary winding of the second igniter transformer and the secondary windings are configured so as to produce the first and second voltages having opposite polarities, and the output end of the secondary winding of the first igniter transformer is configured to supply the first voltage to the one of the electrodes of the lamp, and the output end of the secondary winding of the second igniter transformer is configured to supply the second voltage to the other of the electrodes of the lamp.

17. The ballast according to claim 9, further comprising an igniter transformer drive circuit configured to supply exciting current to the primary winding of the igniter transformer at the start of the lighting of the lamp.

18. The ballast according to claim 13, further comprising an igniter transformer drive circuit configured to supply exciting current to the primary winding of the igniter transformer at the start of the lighting of the lamp.

19. The ballast according to claim 1, wherein the igniter circuit includes a transformer to produce the first and second voltages, the transformer having a primary winding and two secondary windings, and wherein a number of turns of one of the secondary windings is larger than a number of turns of the other of the secondary windings.

20. A projector including the ballast of claim 1.

* * * * *